US006572521B2

(12) United States Patent
Hanna

(10) Patent No.: US 6,572,521 B2
(45) Date of Patent: Jun. 3, 2003

(54) RIBBON CURLING MACHINE AND PROCESS

(76) Inventor: Dean S. Hanna, 1005 Standard St. Suite C, Reno, NV (US) 89506

( * ) Notice: Subject to any disclaimer, the term of this patent is extended or adjusted under 35 U.S.C. 154(b) by 0 days.

(21) Appl. No.: 10/086,128

(22) Filed: Feb. 27, 2002

(65) Prior Publication Data

US 2002/0091054 A1 Jul. 11, 2002

Related U.S. Application Data

(63) Continuation of application No. 09/250,884, filed on Feb. 16, 1999, now Pat. No. 6,331,155.

(51) Int. Cl.[7] ..... B31B 1/36

(52) U.S. Cl. ..... 493/459; 493/955; 493/957; 493/958; 162/271

(58) Field of Search ..... 493/459, 460, 493/461, 955, 957, 958, 454, 10; 162/271, 270, 280; 428/4; 53/134.1, 413

(56) References Cited

U.S. PATENT DOCUMENTS

| | | | | | |
|---|---|---|---|---|---|
| 1,018,227 | A | | 2/1912 | Althen | |
| 1,537,118 | A | | 5/1925 | Kent | |
| 2,339,071 | A | | 1/1944 | Hayes | 93/61 |
| 2,669,913 | A | | 2/1954 | Cerone | 93/1 |
| 2,880,540 | A | * | 4/1959 | Williams | 428/10 |
| 3,779,138 | A | | 12/1973 | Lindstaedt et al. | 93/1 R |
| 3,962,957 | A | | 6/1976 | Hinzmann | 93/1 R |
| 3,971,696 | A | | 7/1976 | Manfredi | 162/271 |
| 3,996,842 | A | | 12/1976 | Ehlich et al. | 93/1 R |
| 4,201,806 | A | * | 5/1980 | Cole | 428/4 |
| 4,300,891 | A | | 11/1981 | Bemiss | 493/8 |
| 4,475,896 | A | | 10/1984 | Bains | 493/454 |
| 4,769,110 | A | * | 9/1988 | Ohno et al. | 156/350 |
| 4,952,281 | A | | 8/1990 | Akira | 162/270 |
| 4,968,540 | A | * | 11/1990 | Linsenbigler | 428/5 |
| 4,980,942 | A | | 1/1991 | Spargo, Sr. | 7/158 |
| 5,156,893 | A | * | 10/1992 | Barthe | 428/4 |
| 5,407,417 | A | | 4/1995 | Goldstein | 493/459 |
| 5,458,726 | A | * | 10/1995 | Castoldi | 156/355 |
| 5,614,274 | A | * | 3/1997 | Huss | 428/5 |
| 5,628,846 | A | * | 5/1997 | Huss et al. | 156/70 |
| 5,771,664 | A | * | 6/1998 | Recchia, Jr. | 53/417 |
| D411,137 | S | * | 6/1999 | Goldstein | D11/184 |
| 5,916,081 | A | * | 6/1999 | Goldstein | 493/459 |
| 6,267,152 | B1 | * | 7/2001 | Doerr et al. | 140/93 A |
| 6,298,639 | B1 | * | 10/2001 | Shea | 53/520 |
| 6,360,413 | B1 | * | 3/2002 | Lopata et al. | 28/147 |

* cited by examiner

*Primary Examiner*—Eugene Kim
*Assistant Examiner*—Christopher Harmon
(74) *Attorney, Agent, or Firm*—Cislo & Thomas LLP

(57) ABSTRACT

A curl bow machine manufactures curl bows. Ribbon unwinds from spools and a curling rod applies controlled tension onto the ribbon, thereby curling it. Several strands of ribbon may be curled simultaneously. The resulting curled ribbon stream passes on to a wire stitcher. The wire stitcher may take hang tags from a hang tag delivery and cutting system to attach individual hang tags to the curled ribbon stream. Alternatively, a backing material or wire tie is used instead of a hang tag. A venturi suction and discharge system may deliver the curled ribbon stream and attached hang tags to a cutter to separate individual curl bows from the ribbon stream. A second nip roller may also be used in place of the venturi suction and discharge system.

10 Claims, 7 Drawing Sheets

RIBBON CURLING MACHINE AND PROCESS

CROSS REFERENCES TO RELATED APPLICATIONS

This patent application is a division of U.S. patent application Ser. No. 09/250,884 filed Feb. 16, 1999, U.S. Pat. No. 6,331,155, for RIBBON CURLING MACHINE AND PROCESS which application is incorporated herein by this reference thereto.

BACKGROUND OF THE INVENTION

1. Field of the Invention

This invention relates to ribbons, bows, package decorations and the like, and more particularly to a machine that curls ribbons in order to make bows of such curled ribbons.

2. Description of the Related Art

Gift-giving is often associated with holidays and special events such as birthdays. In order to hide the gift that is being given, colorful and ornamental papers are often used to wrap the gift to hide any indication of it. Additionally, ribbons and bows made of ribbon are often attached to such wrapped packages in order to enhance the colorful, ornamental, and festive nature of the gift.

Ribbon often comes in rolls of various colors and widths. It is known in the art that the unrolled ribbon may be engaged manually over the back end of a scissors and curled by pulling the dull scissor end along the ribbon. As the ribbon is held in close quarters with the dull angled blade of the scissors, the ribbon takes on a curl that is attractive and decoratively ornamental.

This manual process can be tedious, especially when done on an industrial scale where thousands of ribbons need to be curled in order to achieve commercial ends. Additionally, such commercial need is present where several strands of ribbon are curled in order to make a curl bow, that is a bow made of curled ribbon.

If the task were performed manually, the expense and time involved might be prohibitive. While there are prior attempts in the art to curl and uncurl certain items, generally they are not well applied to the manufacture of curled bows.

The prior art reflects certain material dependency upon the material being curled in the use of nip rollers and the like for curling or uncurling paper, plastic, imitation cork, and even reconstituted tobacco, light weight cardboard, and other materials. However, the prior art does not reflect the use or provision of a machine by which curl bows can be made in a rapid and easy fashion such that the purchasing public can buy an attractive curl bow on a hang tag of several different varieties of ribbons in different colors and visual qualities.

The use of a spinning and cornered spindle in the present invention provides manufacturing efficiencies that are not generally known art, including such prior U.S. patents as U.S. Pat. No. 3,996,842 issued to Ehlich et al. on Dec. 14, 1976 for an Apparatus for reducing and Equalizing Localized Stresses in running Paper Webs or the Like and U.S. Pat. No. 5,916,081 issued to Goldstein on Jun. 29, 1999 for a Ribbon Curling and Shredding device. Neither or these patents set forth the use of a spinning, as opposed to mere turning or even stationary, spindle that uses corners on the spindle to impart curl to the ribbon traveling adjacent to the spindle.

SUMMARY OF THE INVENTION

The present invention provides a method and a machine for incorporating the method in order to achieve the manufacture of curl bows in large numbers.

Strands of ribbon, for example twelve strands of ribbon, are unspooled from individual ribbon rolls and are laced through a ribbon guide that prepares the ribbons for the curl bow manufacture process. Exiting the guide, the ribbons enter a curling station where ribbon is curled in an on-going basis. Pull rollers provide the motivating traction and tension, allowing the ribbon to be pulled from the ribbon rolls through the curling station.

A hang tag is then centrally attached to a certain length of ribbon by a wire stitcher or the like. The long strands of curled ribbon with intermittent hang tags are then taken in by an intake/discharge system and delivered in sequential fashion to a curl bow cutter. The curl bow cutter cuts individual curl bows from the long strands of curled ribbon. Once freed from the long strand, the individual curl bows are expelled out the end of the discharge pipe and into a waiting box or package.

By providing a curl bow making process and a machine incorporating such a process, large numbers of curl bows can be made for the purchase and convenience of the public.

OBJECTS OF THE INVENTION

It is an object of the present invention to provide a method by which curl bows can be made in large numbers.

It is yet another object of the present invention to provide a curl bow machine that reduces a normally manual-intensive process to one that uses machine power to make attractive ornamental curl bows.

It is yet another object of the present invention to provide a curl bow making machine that handles several strands of ribbon simultaneously.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figures 1, 1B:
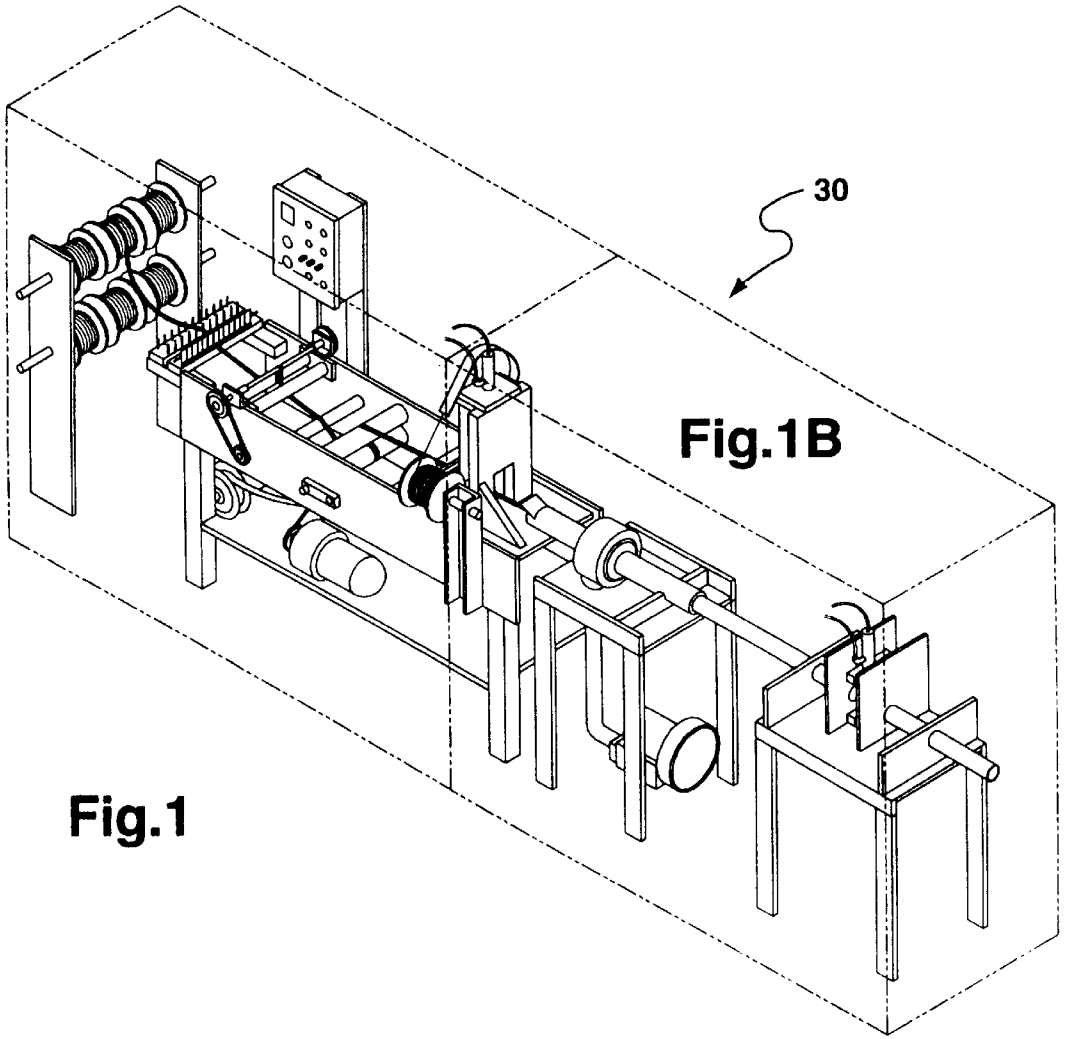
FIG. 1 is a perspective view of the curl bow machine of the present invention.
FIG. 1B is a perspective view of the second half of the curl bow machine of FIG. 1.
Figures 1A, 2:
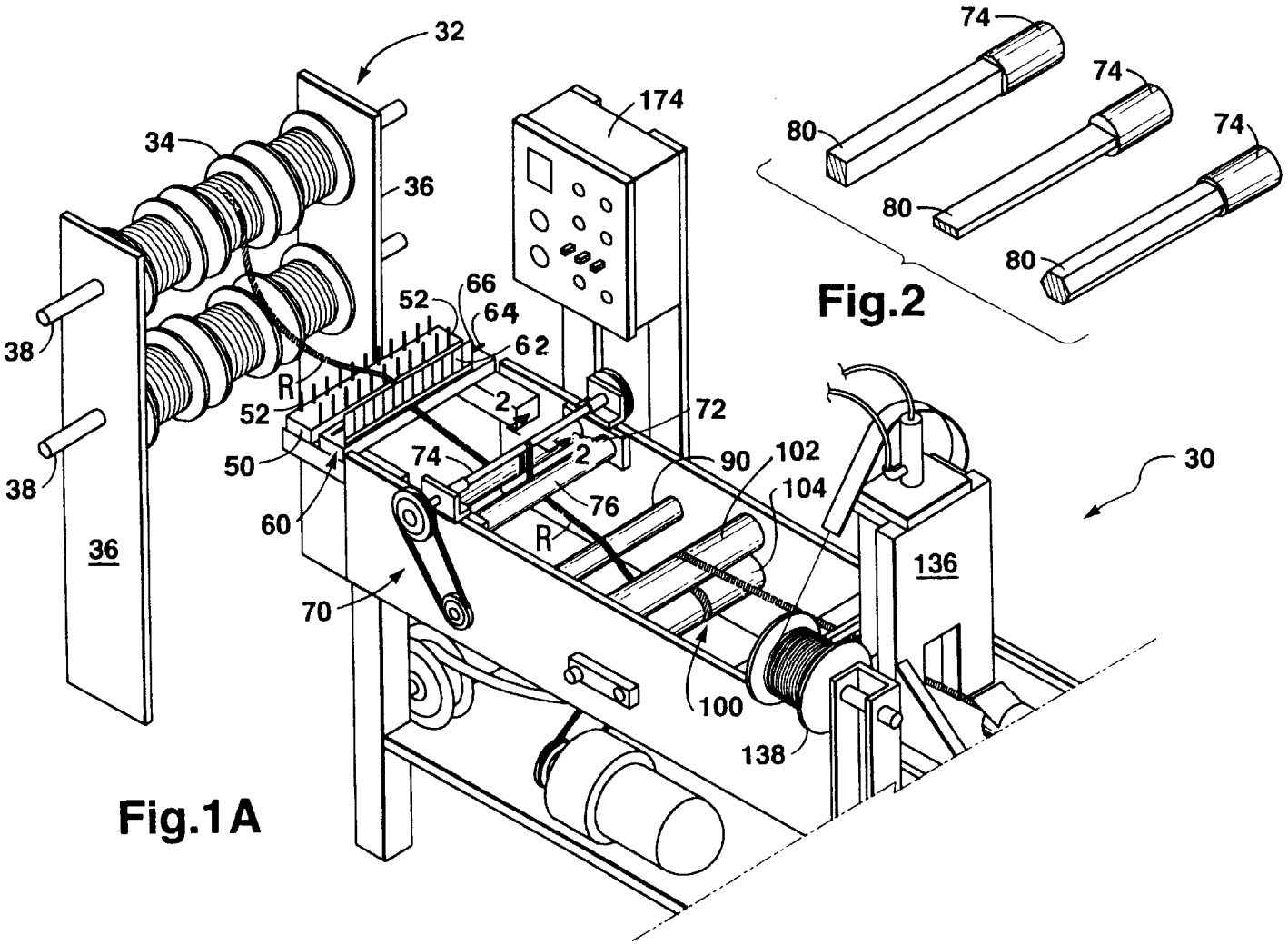
FIG. 1A is a perspective view of the first half of the curl bow machine of FIG. 1.
FIG. 2 is a perspective view of three embodiments of curling spindles used in the present invention, taken generally along line 2—2 of FIG. 1A.
Figure 1B:
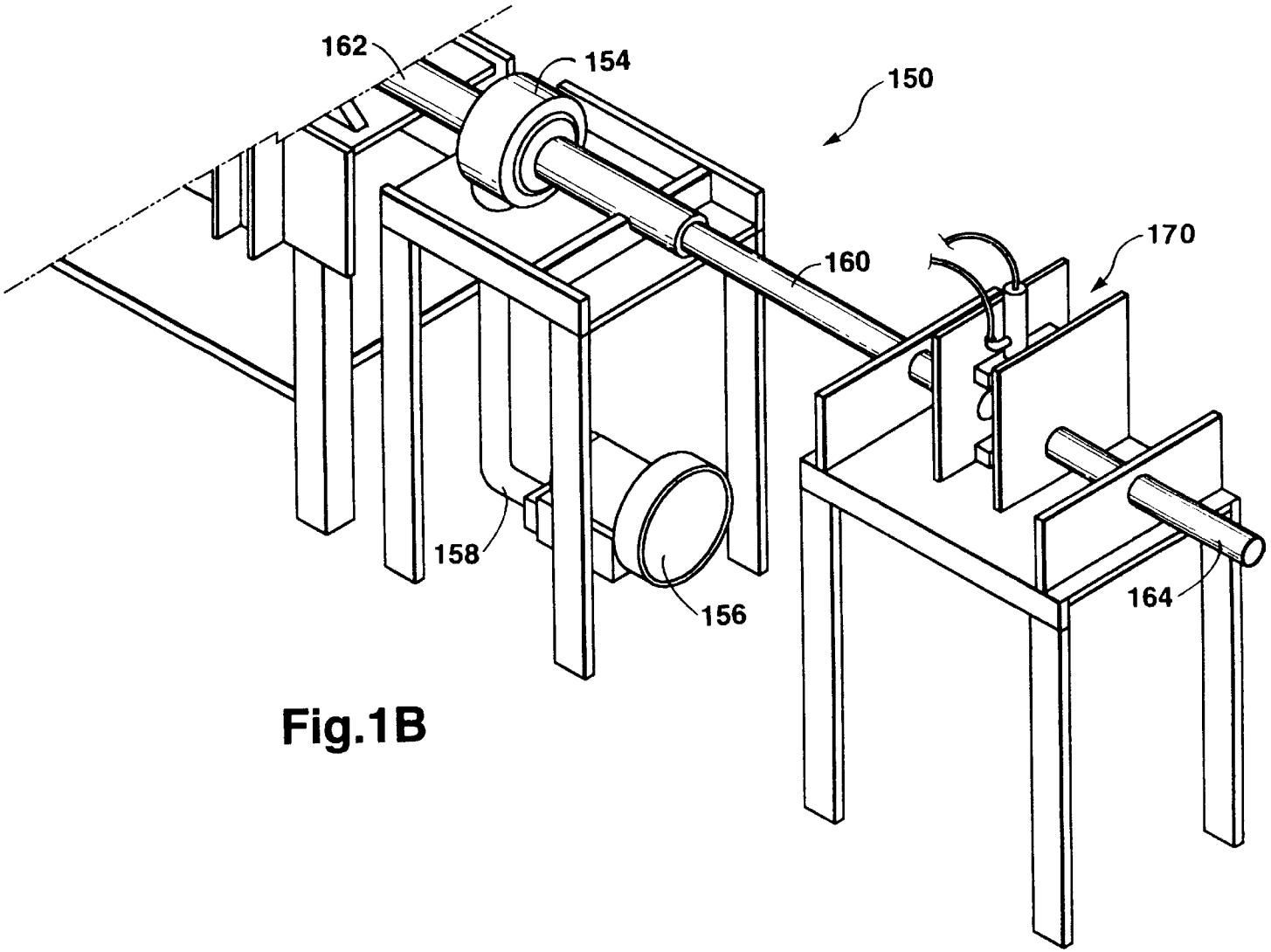

As shown in FIGS. 1, 1A, and 1B (FIGS. 1–1B), the curl bow making machine of the present invention 30 has a ribbon unwinding stand 32 that feeds ribbon into the machine. The ribbon R is shown in FIGS. 1–1B as being a single strand traveling through the curl bow machine 30. For purposes of demonstration, only one strand is shown. However, the ribbon stand 32 can hold a large number of ribbon rolls 34. Generally there is no set number of ribbon strands R that can be accommodated by the curl bow machine 30 of the present invention. In the embodiment shown, twelve strands of ribbon are contemplated as being used to construct curl bows. However, it is possible to widen the machine to incorporate a larger number of ribbon strands R if desired.

The ribbon stand 32 is generally a support for ribbon rolls 34. As shown in FIGS. 1–1B, the ribbon stand 32 may consist merely of supports 36 that hold a rod or shaft 38. The rod 38 then passes centrally through the ribbon bobbin 34 so that it can unspool freely as it is drawn through the curl bow machine 30.

For very large and heavy master rolls of ribbon, a ribbon unwind device may be necessary that serves to reduce the tension the weight of such rolls would exert on the ribbon strand R. The tension caused by the weight of the ribbon spools or bobbins 34 should not exceed the amount of tension introduced into the system at the ribbon tensioning station 60. Under such circumstances, the tension would be higher with a fresh roll than with an old roll and the variable tension might raise havoc with the consistency of the curl of the finished bows. Consistency in the curl of the finished bows is desirable as it allows some controllable variation in the system so that predictable and reliable curl bow manufacture may be achieved.

In order to accommodate such very large and heavy master rolls of ribbon, a mechanical unwind stand of an accumulator type could be used where ribbon is "pre-unwound" in order to decrease or eliminate tension for ribbon entering into the ribbon tensioning station 60. The mechanical unwind stand (not shown) could be mechanically or electronically linked to the curl bow machine 30 in order to provide easily-manipulable and generally free-traveling ribbon. With such an accumulator style of mechanical unwind stand, the ribbon could be pulled off the bobbin or spool 34 and allowed to collect in a free ribbon reservoir or the like until it is pulled into the curl bow machine 30 through the ribbon tensioning station 60.

After leaving the ribbon spool or bobbin 34, the ribbon strand R passes through a ribbon guide 50 where the individual ribbon strands R are separated and guided into the ribbon tensioning station 60. The ribbon guide 50 may be a series of parallel posts 52 that separate the individual ribbon strands R. A piece of foam rubber or the like (not shown) can be placed on top of the ribbon strands R in order to better hold them in place and down upon the ribbon guide 50. Additionally, a light weight can be placed or distributed to top the foam rubber in order to ensure the stability of the foam. The foam rubber may be placed between the strand-separating post 52 and may be sized accordingly such that there is a friction fit between the guide post 52 and the piece of foam rubber.

Having been separated and guided by the ribbon guide 50 the strands of ribbon R are then subject to tensioning at the ribbon tensioning station 60. The ribbon tensioning station 60 individually places tension upon the individual ribbon strands R. The ribbon tension station 60 has a series of lever devices pivoted at a fulcrum.

Figure 9:
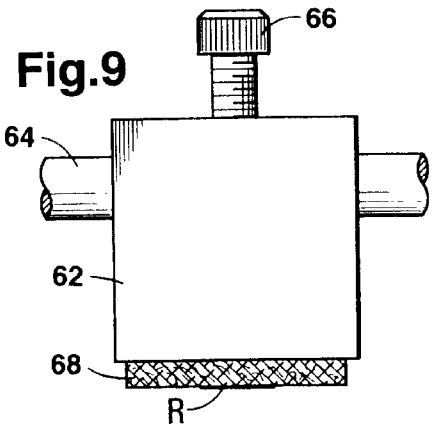
FIG. 9 is a rear view of the lever device shown in FIG. 8.
Figure 8:
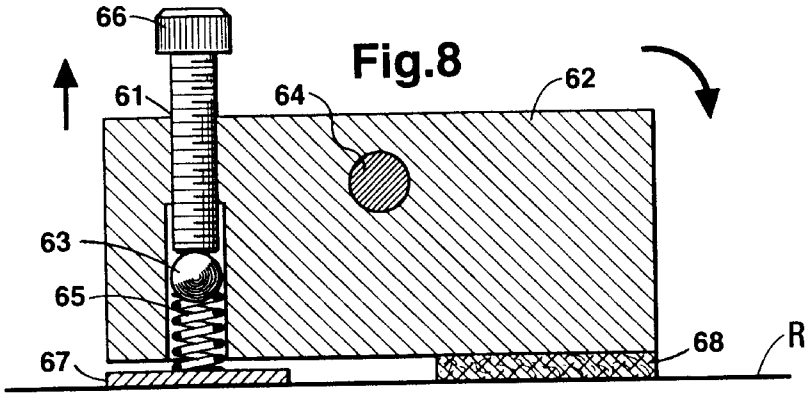
FIG. 8 is a side perspective and partial cutaway view of one of the lever devices exerting tension on an individual ribbon at the ribbon tension station.

In one embodiment, such as that shown in FIGS. 8 and 9, the fulcrum may take the form of a pivoting shaft 64 about which the tension levers 62 pivot. A tensioning bolt on one side of the pivoting shaft 64 serves to adjust the tension upon the ribbon R via a contact pad 68. The tension screw 66 screws into or out of a threaded socket 61 depressed in the tension block 62. The tension screw 66 may then engage a ball bearing 63 which may press down upon a spring 65. The spring 65 in turn presses down upon a plate 67 running across the width of the ribbon tensioning station 60 just above the strands of ribbon R.

When the tension screw 66 is threaded into the threaded socket 61 of the tension block 62, it lifts up on its end of the tension block 62. This forces the opposite end of the tension block 62, the end with the contact pad 68, to press downwardly upon the ribbon R. The pressure of the contact pad 68 upon the ribbon R serves to gently restrict its travel, causing the ribbon R to undergo tension when pulled away from the contact pad 68.

The contact pad 68 may be made of leather, Teflon®, or other low-friction or non-friction surface. Material such as leather may be used in order to minimize scratching and/or marring of the ribbon surface. However, other types of material (such as Teflon® or the like) may also be suitable.

As the decorative appearance of the ribbon strand R is important to the final product, it is important to ensure that the ribbon is not damaged by the tensioning process. The presence of the biased ball bearing serves as means by which some "give" or accommodation can be made for variations in ribbon strand travel through the ribbon tensioning station 60.

Figure 3:
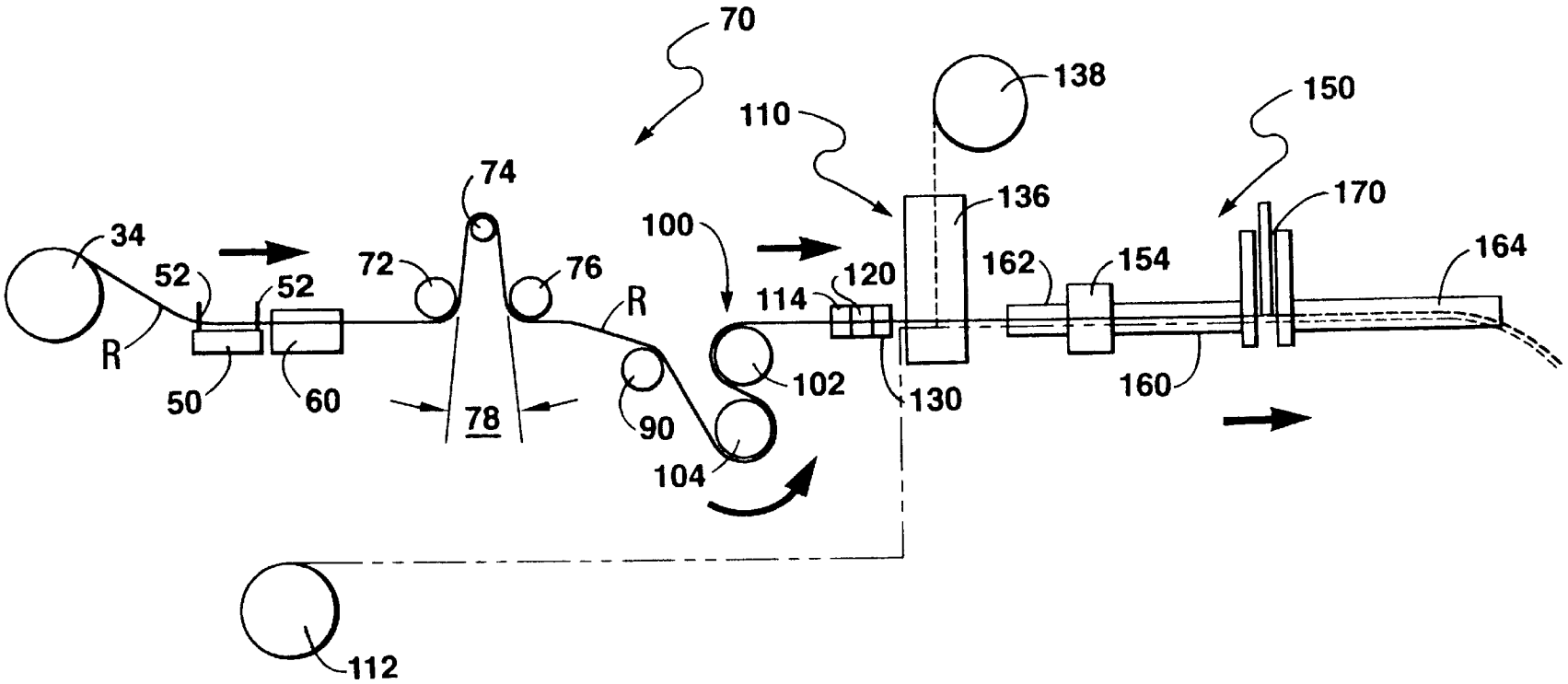
FIG. 3 is a flow diagram schematically indicating the processes and manipulation ribbon is subject to by the curl bow machine of the present invention.

After traveling from the ribbon tensioning station 60, the ribbon strand R then passes through the ribbon curling station 70. The ribbon curling station 70 provides continuous and ongoing means by which ribbon strands R may be curled. As shown in FIGS. 1A and 3, the ribbon curling station 70 has a rear idle roller 72 that forces the ribbon strand R downwardly and away from an upwardly displaced curling bar 74. The ribbon strand R travels over the curling bar 74 and downward to a forward idle roller 76 where the ribbon strand R travels forward and further downstream through the curl bow machine 30. By forming a shared plane from which the curling bar 74 departs, the idle rollers 72, 76 determine the angle 78 the ribbon R makes with the curling bar 74 and help control the curl placed into the ribbon R.

The relative positioning of the idle rollers 72, 76 and the curling bar 74 in the curling station 70 are important features in the present invention. The curling bar 74 places the curl into the ribbon strand R and does so in conjunction with the tension and angle 78 placed upon the ribbon R as it passes over the curling bar 74.

The curling bar 74 may take a variety of working cross sections as shown in FIG. 2. A square cross section may be used for the curling bar 74. A rectangular cross section and a hexagonal cross section may also be used. Other cornered shapes such as triangles or pentagons may also be used to good advantage. All of these curling bar cross sections have corners 80 about which the ribbon strand R must travel as it passes through the curl bow machine 30. These corners are generally sharp or tight, although the travel of the ribbon strand R over the corners 80 does not injure or cut the ribbon strand R. It can be seen that the curling bar 74 acts in the same way as the dull back-side of a scissors blade does in allowing a person to curl ribbon manually. The ribbon R travels in an acute angle 78 over the curling bar 74 and is drawn over the curling bar corners 80 to thereby introduce or induce curl into the ribbon strand R.

In order to better enhance the curling activity of the curling bar 74, the curling bar rotates or spins. The rotation of the curling bar 74 has been found to most advantageously introduce curl into the ribbon strand R when the rotational curling bar speed is greater than that of the ribbon R. Additionally, it has been found that rotating the curling bar in a direction the same as the travel of the ribbon strand R is better than rotating against the travel of ribbon strand R.

In one embodiment, the curling bar 74 is driven by an adjustable DC motor capable of speeds up to 1750 R.P.M. By adjusting the cross section of the curling bar 74, the rotational speed of the curling bar 74 and adjusting the lateral displacement or distance between the rear and forward idle rollers 72, 74, adjustable variation in the curling of the ribbon strand R can be achieved in order to provide adjustable and selectable curling in the ribbon strand R and the ultimate curl bow. As several strands of ribbon R can travel over the curling bar 74 simultaneously, several ribbon strands R are curled or have curl introduced into them at the curling station 70.

Having curled the ribbon strands R, it then necessary to attach hang tags to the curled ribbons and separate the individually enribboned hang tags in order to form curl bows. Certain mechanical requirements are necessary as control over the ribbon strand R must be achieved in a predictable and reliable manner.

An idle roller 90 may be present past the curling station 70. The idle roller 90 serves as a guide and to remove slack in the ribbon strand R.

A ribbon pulling station 100 has a top pull roller 102 engaging a bottom pull roller 104. The top 102 and bottom 104 pull rollers form an air-actuated nip that places tension upon the ribbon strand R and pulls it through the upstream ribbon stations. In traveling over the top and bottom rollers 102, 104, the ribbon R forms an "S" shape. The "S" shape of the ribbon causes it to engage the rollers 102, 104 to a greater extent, allowing them to exert greater control over the travel of ribbon R. The top pull roller 102 may be the driving roller of the nip while the bottom pull roller 104 may be the idle roller.

The tension in the ribbon strand R generated between the ribbon pulling station 100 and the ribbon tensioning station 60 is imposed upon the ribbon as it passes through curling station 70. This tension serves to allow the ribbon curling station 70 to introduce its curl into the ribbon strand R. The remaining actions performed on the ribbon are then driven by the venturi suction and discharge system about which more is set forth, below.

Having created several strands of curled ribbon R, a hang tag (not shown) as known in the art is then attached to the bundled ribbon stream from which the curled bows may be cut. As set forth herein, the term "hang tag" includes backing material of any useful sort or nature in order to achieve the curled bows as set forth herein. As used herein, the term "hang tag" indicates all manners of substrates to which the ribbon stream may be affixed to achieve curl bows. It is understood that hang tags may be omitted from the creation of the curl bows. A staple or other fastener may be used on its own to fasten the separate strands of ribbon in the curl bows. Additional embodiments include the use of wires, twist ties, or the like to achieve the fastening of the individual ribbon strands.

In FIGS. 1A and 3, once the ribbon strand R leaves the ribbon pulling station 100, the ribbon then approaches the hang tag attachment station 110. At the hang tag station 110, a roll of hang tags 112 has its free end engaged by a hang tag feeder 114. The hang tag feeder has a driver, such as a 12 volt DC gear motor and a small nip roller. The hang tag feeder advances the hang tag from the master hang tag roll 112 and uses a micro switch or other sensing device to maintain registration of the hang tags with the ribbon stream to position the hang tag under the wire stitcher. The hang tags are generally stiff in nature, generally being a piece of card stock or the like to which adhesive is affixed covered by a non-adhesive peel-off layer. A channel generally corresponding to the width of the hang tags allow them to be driven under the ribbon stream until attachment is made ready under the wire stitcher.

A hang tag cutter 120 can operate in a scissor-like, guillotine, or other manner in order to cut individual hang tags from the master roll 112. Due to the stiff nature of the individual hang tags, the fact they are constrained to move within the channel, forward motion of the uncut length of hang tag serves to move forward the individually cut hang tags that are formed by the hang tag cutter 120. The length of the individual hang tags are determined between the hang tag feeder 114 and the hang tag cutter 120. Coordination of these two devices determines the length of the individual hang tags.

Prior to the attachment of the ribbon strands to the hang tag, the ribbons are gathered together at a ribbon gathering station 130. In one embodiment, a narrow oval slot can be used to gather the ribbon strands together for attachment to the hang tag. Alternatively, it is seen as being more advantageous to provide a sliding slot that opens and closes in order to better gather together the individual ribbon strands. The sliding slot may be formed between two air cylinders and coordinated with the operation of the wire stitcher as well as the other elements of the hang tag attachment station 110 in order to gather the ribbon strands together in the most efficient and/or attractive manner.

Figure 5:
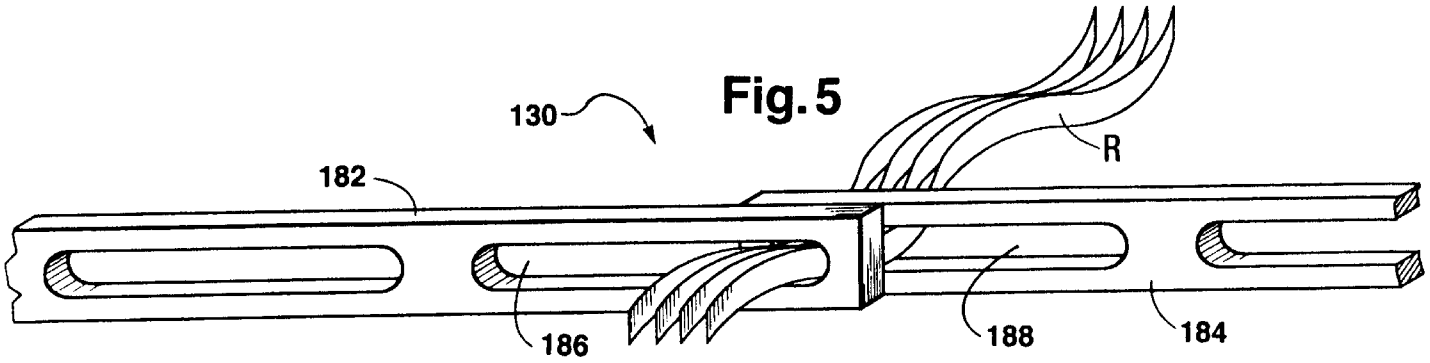
FIG. 5 shows a right upper perspective view of the ribbon gathering station in a closed configuration.
Figure 4:
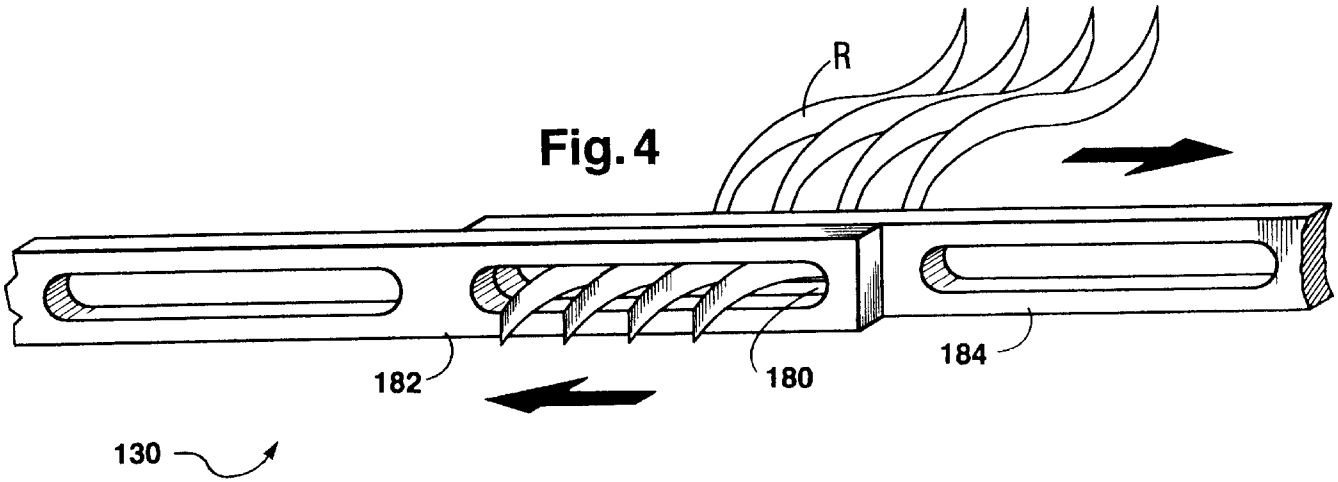
FIG. 4 shows a right side perspective view of a ribbon gathering station of the present invention in an open position.

As shown in FIGS. 4 and 5, the ribbon gathering station 130 may take the form of a controllable slot aperture 180 through which the strands of ribbon travel. In the embodiment shown in FIGS. 4 and 5, the ribbon gathering station 130 has laterally-traveling extension bars or the like 182, 184. Each of the extension bars has a corresponding oval or other shaped aperture 186, 188 through which the ribbon may travel. The extension bars are configured so that they travel in aligned and offset paths so as to act like a shutter or iris controlling the controllable slot aperture 180 and its cross-section.

In FIG. 4, the ribbon is allowed to travel through an open or wide controllable slot aperture 180 as the air cylinders controlling the extension bars have extended the bars outward and towards each other so that the cross-section of the controllable slot aperture 180 is generally the same or similar as each of the cross-sections of the left and right ribbon apertures 186, 188. In FIG. 5, the air cylinders have retracted the extension bars 182, 184 so that the intersection of the left and right ribbon apertures 186, 188 forming the controllable slot aperture 180 is now constricted or contracted so that the ribbons are gathered together generally midway between the two laterally-traveling extension bars 182, 184.

Free travel of the ribbon stream is generally available through the configuration shown in FIG. 4 with the open controllable slot aperture 180. When the ribbon is to be stitched together or affixed to a hang tag or the like, the ribbon stream travel is temporarily stopped and the ribbons are gathered together as shown in FIG. 5. The ribbons may then be fastened to one another via a hang tag, staple, twist tie, juncture, or the like adjacent the contracted controllable slot aperture 180. It may be more advantageous to have the point of attachment of the individual ribbon strands downstream of the ribbon gathering station 130. This allows freer travel of the juncture of the ribbon strands and allows it to pass downstream without passing through the ribbon gathering station 130, the controllable slot aperture 180, or similar devices.

Figure 6:
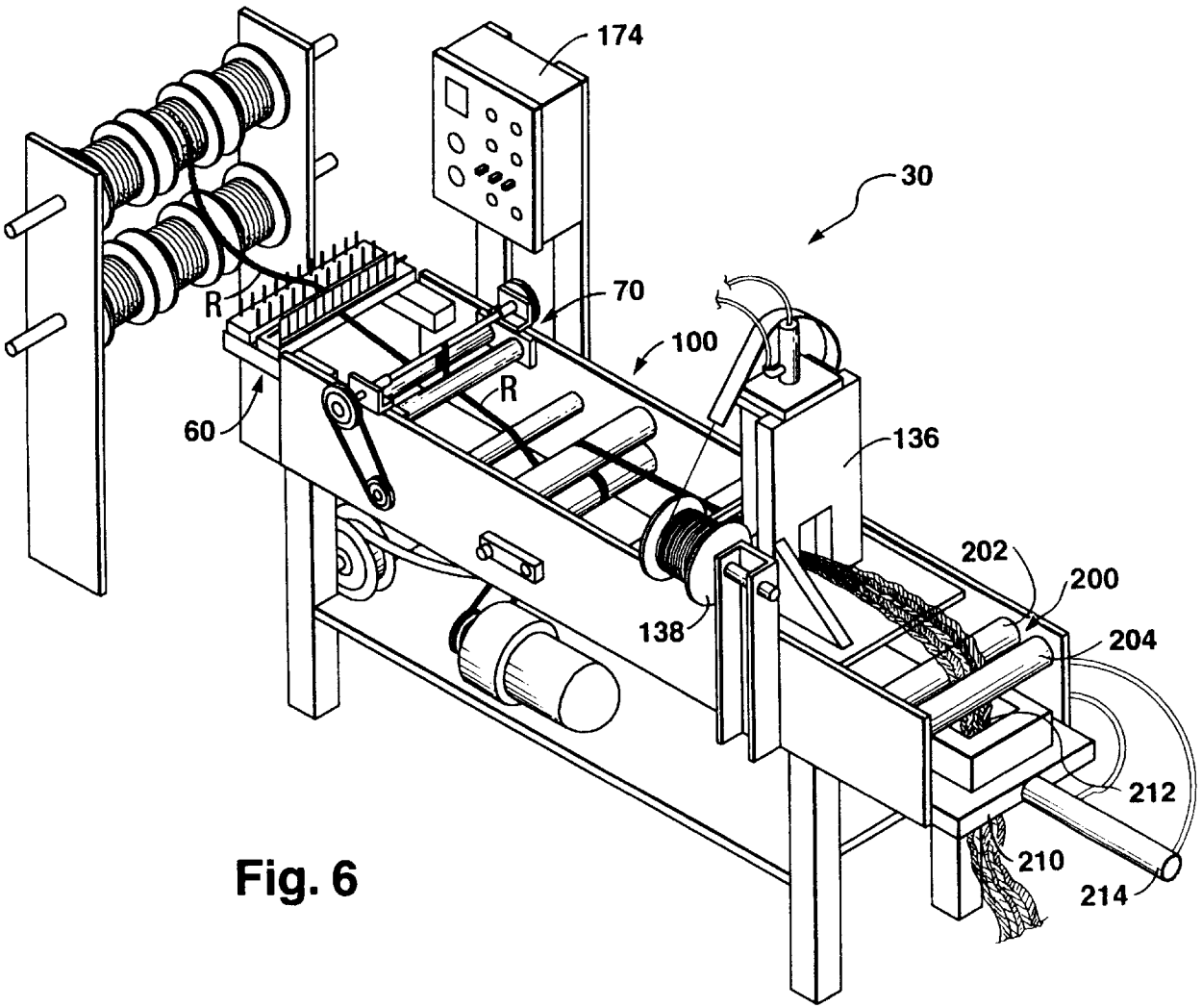
FIG. 6 shows an alternative embodiment of the present invention where rear pull rollers pull and guide the ribbon stream to a ribbon cutter.

Note should be taken that with the embodiment of the present invention using back pull rollers, such as that shown in FIG. 6, the gathering station becomes more important in the design, construction, and fabrication of the curl bow machine 30. Due to increased tension in the ribbon strands R, the ribbon gathering station 130 must be opened wider to ensure that the ribbon flows through the gathering station (controllable slot aperture 180) unimpeded. If the ribbon R is restricted in its travel through the oval channel 180, the rubbing or abrading of the ribbon on any part of the laterally-traveling extension bars 182 may de-curl the ribbon. This generally defeats the intended purpose of the machine to provide attractive and curly ribbon bows.

An example of the de-curling process to be avoided when the ribbon R travels through the oval channel 180 is the curling of the piece of ribbon on one side of the pair of scissors and then curling the same piece of ribbon on its other side. The curling of the ribbon on its reverse side causes much of the original curl to be lost. When a venturi flow system is used to pull or propel the ribbon R through the curl bow machine 30 of the present invention, the concerns with regards to de-curling are diminished as the tension upon the ribbon R is much less with the venturi system than it is with the rear pull roller system.

The ribbon gathering station 130 is open or wide when the ribbon is passing through the channel, but may be closed when the wire stitcher attaches the ribbons to the hang tag.

The wire stitcher 136 or other fastening device (such as a stapling device or stapler) forms and attaches staples or other fasteners to the hang tag or bow chip. Alternatively, the ribbons R may be joined to one another by a fastener without a hang tag, bow chip, or other foundation. A spool of stiff wire forms the feed stock for the wire stitcher. The wire stitcher 136 may be pneumatically operated to take a short length of wire off of the spool 138 and form a staple with it. The staple is then used to partially circumscribe the ribbons gathered by the ribbon gathering station 130. The ends of the staple then perforate the hang tag, with the exposed ends of the staple bent in order to secure the staple and the curled ribbons to the hang tag.

Alternatively, a stapler or other stapling/fastening device may serve to attach the individual ribbon strands of the ribbon stream to one another and to a hang tag, if present.

The completed curl bow is almost finished. However, after the wire stitcher 136 is affixed to the hang tag to curled ribbon strand R, a stream of curled ribbon with attached hang tags is then created.

In some embodiments, back pull rollers may be used in order to further move the ribbon strands with the attached hang tag bow chips. However, it has been found that a venturi suction and discharge system 150 may be advantageously used without adversely affecting the forming curl bow.

Figure 7:
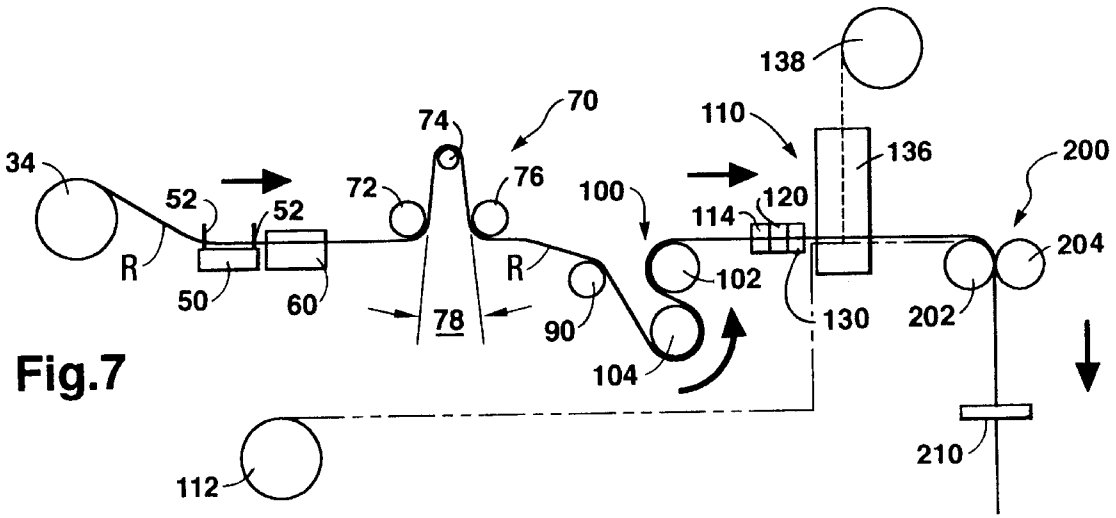
FIG. 7 is a flow diagram schematically indicating the processes and manipulation the ribbon is subject to by the curl bow machine of the present invention as shown in FIG. 6.

When back pull rollers are used, FIG. 7 shows one embodiment wherein they may be advantageously used. In FIG. 7, a setup similar to that as described above is in place where the ribbon stream is curled and joined together before traveling onward into a collection basket or otherwise. As shown in FIG. 7, the rear nip 200 is formed between two rear pull rollers: a driving roller 202 and a idle roller 204. In one embodiment, no "S" wrap is used and the idle roller 204 is positioned on air cylinders to open and close the rear nip 200. When the idle roller 204 closes upon the ribbon stream R and the driving roller 202, the rear nip 200 is closed and the curl bow ribbon travels through the rear nip 200 and on to the ribbon cutter 210.

The rear driving roller 202 may be powered by the front driving roller 102. The rear driving roller 202 may have a variable pitch pulley so that the take-up speed of the rear nip 200 can be adjusted relative to the speed of the ribbon pulling station 100 (or front nip 100). The increased difference in the take-up speed in the rear nip 200 with respect to the front nip 100 is achieved in order to drive the second pair of rollers at speeds slightly faster than the first pair. This keeps tension in the ribbon and facilitates the passage of the ribbon through the ribbon gathering station 130, particularly during the stitching phase or step. Caution must be taken so that the ribbon strands R are not overly tensioned. If too much tension is applied to the ribbon strands R, some of the curl imparted to the ribbon by the ribbon curling station 70 may be lost.

Once the ribbon stream R (with its hang tag or other fastener) is passed through the rear nip 200, it passes on to the ribbon cutter 210. The ribbon cutter 210 may be an air cylinder-driven guillotine-type cutter or otherwise that separates the individual curl bows from one another, generally midway and between the junctures, hang tags, or otherwise. A collection basket or station may then be positioned underneath the ribbon cutter (as shown in FIG. 6) in order to gather the finished curl bows. Alternatively, an open bag or the like may be used to collect the finished curl bows so that they may be easily packaged for transport and sale.

As shown in FIG. 6, the ribbon cutter 210 has a guillotine blade 212 connected to an air cylinder 214. When activated by the control panel 174 or otherwise, the air cylinder 214 extends the guillotine blade 212 to cut the ribbon stream R.

Alternatively, the venturi suction and discharge system 150 uses lengths of pipe or tubing in conjunction with a "T"-type joiner 154 in order to create a forced air passage through which the ribbon stream must pass on its way to the cutter 170.

As shown in FIG. 1B, regenerative blower 156 provides the air flow for the venturi system 150. A length of pipe or tubing 158 transmits the air blown by the regenerative blower 156 to the T-junction 154. The T-junction 154 preferentially directs the air stream from the regenerative blower 156 through the discharge pipe 160. Air flow from the regenerative blower supply pipe 158 to the discharge tubing 160 creates a low-pressure area inside the T-junction 154. Air flow coming into the T-junction through the intake pipe 162 serves to relieve this partial vacuum. The inrush of air flowing into the T-junction 154 through the intake pipe 162 also brings with it the ribbon stream with attached hang tags. Once the ribbon stream R is conducted past the T-junction 154, the pressure of the forced air flow serves to push the ribbon stream onward towards the curl bow cutter 170. Once the ribbon stream has been fed past the T-junction 154, the pressure of the forced air may predominate in propelling the ribbon stream.

The curl bow cutter 170 may be a pneumatically actuated guillotine-type cutter that slices and severs the ribbon stream in order to create the individual curl bows. When the ribbon stream has passed by the curl bow cutter 170 so as to place the blade approximately midway between two hang tags, all the ribbon strands may be cut simultaneously by the cutting blade of the curl bow cutter 170. The newly-formed curl bow at the end of the ribbon stream is then free to flow onward through the exit pipe 164 until exiting therefrom. The curl bow may then be caught in its fall to the floor by a box or the like or a convenient package for future sealing and delivery for sale.

The motion of the ribbon stream through the venturi system 150 may be controlled by the ribbon pulling station 100. A ninety volt DC gear motor and clutch assembly may drive the top and bottom pull rollers 102, 104 of the ribbon pulling station 100. By intermittently stopping and pulling the ribbon stream, the ribbon pulling station 100 controls the length of the ribbon stream passing through the curl bow cutter 170 and the length of the ribbons composing the ultimate finished curl bow. The ribbon pulling station 100 can hold the entire ribbon stream in the appropriate position for proper cutting by the curl bow cutter 170.

Consequently, it can be seen that the ribbon pulling station 100 also acts as a ribbon holding station and serves as both means by which the ribbon stream R may be pulled over the ribbon curling station 70 and held into proper place for cutting by the curl bow cutter 170. The operation of the hang tag attachment station 110 is coordinated with the operation of the ribbon pulling station 100 and may dictate the relative positioning between the hang tag attachment station 110 and the curl bow cutter 170. For example, the ribbons of the curl bow may be equally disposed on either side of the hang tag by propitious disposition of either the ribbon pulling station 100 (and its timely operation) and/or the positioning of the curl bow cutter 170. The curl bow cutter 170 may be repositioned as appropriate to achieve centering of the hang tag on curl bow and/or length of ribbon strands used to compose the curl bow.

As shown in FIG. 1A, a control panel 174 may be present and provide means by which control may be exercised over the operation of the curl bow machine 30. Speeds and forces of operation with respect to the individual elements, particularly the ribbon pulling station 100, the hang tag delivery and cutting apparatus 110, and the curl bow cutter 170 may be provided through the control panel 174.

The regenerative air blower 156 may incorporate a 480-volt, three-phase motor or the like in order to provide sufficient air flow.

In alternative embodiments, a quartz heater may be used to introduce curl into the ribbon R at the ribbon, guiding and tensioning stations 50, 60, respectively. Once heated, the ribbon R takes approximately five (5) minutes to cool and set. Alternatively, and as mentioned above, additional pull rollers may be used as an alternative to the venturi air flow system 150 set forth above. However, none of these elements are seen as preferable at this time. However, specific circumstances may alter the advantageous nature of these elements, which should be considered as possible additions or alternative embodiments of the present invention.

While the present invention has been described with regards to particular embodiments, it is recognized that additional variations of the present invention may be devised without departing from the inventive concept.

What is claimed is:

1. A machine for making bows of curled ribbon; comprising:

a ribbon guide, said ribbon guide receiving ribbon and separating said ribbon from other ribbon strands;

a ribbon tensioning station, said ribbon tensioning station applying tension to said ribbon and comprises a pivotable lever, said pivotable lever exerting pressure upon said ribbon as said ribbon passes said pivotable lever; and a pressure adjustment, said pressure adjustment coupled to said pivotable lever and controlling pressure upon said ribbon by said pivotable lever;

a ribbon curling station, said ribbon curling station curling said ribbon;

a ribbon pulling station, said ribbon pulling station pulling said ribbon through said ribbon tensioning station and said ribbon curling station;

a hang tag feeder, said hang tag feeder feeding hang tags in a consistent manner, said hang tags for attachment to said ribbon;

a ribbon gathering station, said ribbon gathering station gathering together strands of ribbon, including said ribbon;

a hang tag attachment station, said hang tag attachment station receiving hang tags from said hang tag feeder and attaching said hang tags to said gathered strands of ribbon;

a ribbon exit drive, said ribbon exit drive impelling said ribbon away from said hang tag attachment station; and a curl bow cutter, said curl bow cutter severing said ribbon between pairs of attached hang tags; whereby ribbon is fed into the curl bow machine at a first end, hang tags are fed into the curl bow machine at an intermediate station, and curl bows are delivered at a terminal end of the curl bow machine, and wherein said pivotable lever further comprises:

a spring, said spring contained within said pivotable lever; and a ball, said ball held within said pivotable lever, said spring urging said ball away from said pivotable lever; whereby said ribbon engages said ball with said ball tending to hold said ribbon in place, said spring allowing said ribbon to work against said ball resiliently while said ribbon is held in tension by said pivotable lever.

2. A machine for making bows of curled ribbon, comprising:

a ribbon guide, said ribbon guide receiving ribbon and separating said ribbon from other ribbon strands;

a ribbon tensioning station, said ribbon tensioning station applying tension to said ribbon;

a ribbon curling station, said ribbon curling station curling said ribbon;

a ribbon pulling station, said ribbon pulling station pulling said ribbon through said ribbon tensioning station and said ribbon curling station;

a hang tag feeder, said hang tag feeder feeding hang tags in a consistent manner, said hang tags for attachment to said ribbon;

a ribbon gathering station, said ribbon gathering station gathering together strands of ribbon, including said ribbon;

a hang tag attachment station, said hang tag attachment station receiving hang tags from said hang tag feeder and attaching said hang tags to said gathered strands of ribbon;

a ribbon exit drive, said ribbon exit drive impelling said ribbon away from said hang tag attachment station; and a curl bow cutter, said curl bow cutter severing said ribbon between pairs of attached hang tags; whereby ribbon is fed into the curl bow machine at a first end, hang tags are fed into the curl bow machine at an intermediate station, and curl bows are delivered at a terminal end of the curl bow machine, wherein said ribbon curling station further comprises:

a spindle having corners, said cornered spindle spinning at a first speed (RPM) and a first tangential linear speed, said spindle having a spindle cross-section;

said ribbon traveling over said cornered spindle at a second speed; and said spindle spinning at said first tangential linear speed faster than said ribbon speed; whereby said corners of said spindle locally stretch or stress said ribbon, thereby curling said ribbon and wherein said ribbon curling station further comprises:

a first idle roller, said first idle roller disposing said ribbon in a first lateral position on a first side of said spinning cornered spindle;

said spinning cornered spindle disposed in a second lateral position; and a second idle roller, said second idle roller disposing said ribbon in said first lateral position on a second side of said spinning cornered spindle, said first and second idle rollers defining a roller plane from which said spinning cornered spindle is offset by a distance equal to the difference between said roller plane in said first lateral position and said spinning cornered spindle in said second lateral position; whereby said ribbon travels about said spinning cornered spindle in a manner forcing engagement by said ribbon with said spinning cornered spindle and further wherein said first and second rollers being independently and laterally adjustable in said roller plane.

3. A machine for making bows of curled ribbon, comprising:

a ribbon guide, said ribbon guide receiving ribbon and separating said ribbon from other ribbon strands;

a ribbon tensioning station, said ribbon tensioning station applying tension to said ribbon;

a ribbon curling station, said ribbon curling station curling said ribbon;

a ribbon pulling station, said ribbon pulling station pulling said ribbon through said ribbon tensioning station and said ribbon curling station;

a hang tag feeder, said hang tag feeder feeding hang tags in a consistent manner, said hang tags for attachment to said ribbon;

a ribbon gathering station, said ribbon gathering station gathering together strands of ribbon, including said ribbon and comprises:

a first laterally-traveling extension bar;

a second laterally-traveling extension bar, said second laterally-traveling extension bar adjacent and oppositely opposed to said first laterally-traveling extension bar;

said first and second laterally-traveling extension bars defining a controllable slot aperture, or iris, through which ribbon may travel and be controllably gathered together;

a hang tag attachment station, said hang tag attachment station receiving hang tags from said hang tag feeder and attaching said hang tags to said gathered strands of ribbon;

a ribbon exit drive, said ribbon exit drive impelling said ribbon away from said hang tag attachment station; and a curl bow cutter, said curl bow cutter severing said ribbon between pairs of attached hang tags; whereby ribbon is fed into the curl bow machine at a first end, hang tags are fed into the curl bow machine at an intermediate station, and curl bows are delivered at a terminal end of the curl bow machine and wherein said ribbon gathering station further comprises:

said first laterally-traveling extension defining a first ribbon aperture; and said second laterally-traveling extension defining a second ribbon aperture; whereby said controllable slot aperture is formed by the intersection of said first and second ribbon apertures of said first and second laterally-traveling extensions, respectively.

4. A machine for making bows of curled ribbon, comprising:

a ribbon guide, said ribbon guide receiving ribbon and separating said ribbon from other ribbon strands;

a ribbon tensioning station, said ribbon tensioning station applying tension to said ribbon;

a ribbon curling station, said ribbon curling station curling said ribbon;

a ribbon pulling station, said ribbon pulling station pulling said ribbon through said ribbon tensioning station and said ribbon curling station;

a hang tag feeder, said hang tag feeder feeding hang tags in a consistent manner, said hang tags for attachment to said ribbon;

a ribbon gathering station, said ribbon gathering station gathering together strands of ribbon, including said ribbon;

a hang tag attachment station, said hang tag attachment station receiving hang tags from said hang tag feeder and attaching said hang tags to said gathered strands of ribbon;

a ribbon exit drive, said ribbon exit drive impelling said ribbon away from said hang tag attachment station; and a curl bow cutter, said curl bow cutter severing said ribbon between pairs of attached hang tags; whereby ribbon is fed into the curl bow machine at a first end, hang tags are fed into the curl bow machine at an intermediate station, and curl bows are delivered at a terminal end of the curl bow machine;

a spindle having corners, said cornered spindle spinning at a first speed (RPM) and a first tangential linear speed, said spindle having a spindle cross-section;

said ribbon traveling over said cornered spindle at a second speed; and said spindle spinning at said first tangential linear speed faster than said ribbon speed; whereby said corners of said spindle locally stretch or stress said ribbon, thereby curling said ribbon.

5. The machine for making bows of curled ribbon of claim 4, wherein said spindle cross-section is selected from the group consisting of:

squares, rectangles, triangles, pentagons, and hexagons.

6. The machine for making bows of curled ribbon of claim 4, wherein said ribbon curling station further comprises:

a first idle roller, said first idle roller disposing said ribbon in a first lateral position on a first side of said spinning cornered spindle;

said spinning cornered spindle disposed in a second lateral position; and a second idle roller, said second idle roller disposing said ribbon in said first lateral position on a second side of said spinning cornered spindle, said first and second idle rollers defining a roller plane from which said spinning cornered spindle is offset by a distance equal to the difference between said roller plane in said first lateral position and said spinning cornered spindle in said second lateral position; whereby said ribbon travels about said spinning cornered spindle in a manner forcing engagement by said ribbon with said spinning cornered spindle.

7. A machine for making bows of curled ribbon, comprising:

an unwinding stand;

a spool of ribbon, said spool of ribbon holding ribbon wound upon said spool, said ribbon spool held by said unwinding stand and supplying ribbon;

a ribbon guide, said ribbon guide receiving ribbon from said unwinding stand and separating said ribbon from other ribbon strands;

a pivotable lever, said pivotable lever exerting pressure upon said ribbon as said ribbon passes said pivotable lever;

a pressure adjustment, said pressure adjustment coupled to said pivotable lever and controlling pressure upon said ribbon by said pivotable lever;

a spring, said spring contained within said pivotable lever;

a ball, said ball held within said pivotable lever, said spring urging said ball away from said pivotable lever so that said ball engages said ribbon with said ball tending to hold said ribbon in place, said spring allowing said ribbon to work against said ball resiliently while said ribbon is held in tension by said pivotable lever;

a spindle having corners, said cornered spindle spinning at a first speed (RPM), said spinning cornered spindle disposed in a first lateral position and having a spindle cross-section selected from the group consisting of squares, rectangles, triangles, pentagons, and hexagons;

a first idle roller, said first idle roller disposing said ribbon in a second lateral position offset from said first lateral position, said first idle roller on a first side of said spinning cornered spindle;

a second idle roller, said second idle roller disposing said ribbon in said second lateral position on a second side of said spinning cornered spindle, said first and second idle rollers defining a roller plane from which said spinning cornered spindle is offset by a distance equal to the difference between said roller plane in said second lateral position and said spinning cornered spindle in said first lateral position so that said ribbon travels about said spinning cornered spindle in a manner forcing engagement by said ribbon with said spinning cornered spindle;

said first and second rollers being independently and laterally adjustable in said roller plane;

said ribbon traveling over said cornered spindle at a second speed;

said spindle spinning faster than said ribbon speed so that said corners of said spindle locally stretch or stress said ribbon, thereby curling said ribbon;

first and second pull rollers, said first and second pull rollers forming a nip, said ribbon threaded through and engaged by said nip, said nip pulling said ribbon past said pivotable lever and said spinning cornered spindle, said first roller driven by a drive motor having a clutch, said drive motor and said clutch driving said ribbon pulling station regularly and intermittently;

a hang tag feeder, said hang tag feeder feeding hang tags in a consistent manner, said hang tags for attachment to said ribbon;

a microswitch, said microswitch coupled to said hang tag feeder and detecting a position of hang tags in said hang tag feeder;

a hang tag cutter, said hang tag cutter severing an individual hang tag from a roll or stream of hang tags fed by said hang tag feeder;

a movable piston, said movable piston defining one side of a variable channel receiving said ribbon and gathering together strands of ribbon, said variable channel being wide when receiving said ribbon and being narrow to confine lateral travel of said ribbon when said ribbon is ready to be attached to a hang tag so that said ribbon is aligned with hang tags fed by said hang tag feeder and said ribbon is made ready for attachment to one of said hang tags;

a wire stitcher, said wire stitcher stitching said ribbon to said hang tag by forming a staple from a roll of wire and attaching said ribbon to said hang tag with said staple;

a venturi airflow drive, said venturi airflow drive receiving said ribbon from said hang tag attachment station, said venturi airflow drive impelling said ribbon away from said hang tag attachment station so that said ribbon is displaced or moved without pinching or rolling; and a curl bow cutter, said curl bow cutter severing said ribbon between pairs of attached hang tags; whereby ribbon is fed into the curl bow machine at a first end, hang tags are fed into the curl bow machine at an intermediate station, and curl bows are delivered at a terminal end of the curl bow machine.

8. The machine for making bows of curled ribbon of claim 7, wherein said venturi airflow drive further comprises:

a ribbon intake;

a ribbon exhaust;

a junction connection connecting said ribbon intake and said ribbon exhaust; and a supply of pressurized air, said junction connection directing said pressurized air to said ribbon exhaust; whereby said ribbon is drawn into said ribbon intake by venturi effect and propelled by said pressurized air to said ribbon exhaust upon reaching said junction.

9. The machine for making bows of curled ribbon of claim 7, wherein said unwinding stand comprises a mechanical unwinding stand that actively unspools ribbon from said spool of ribbon thereby reducing tension on said ribbon as it passes into said ribbon guide.

10. The machine for making bows of curled ribbon of claim 7, further comprising:

a heater, said heater located adjacent said ribbon, said heater heating said ribbon to curl said ribbon, said heater located adjacent said ribbon at a location selected from the group consisting of: adjacent said ribbon guide, adjacent said pivotable lever, and adjacent both said ribbon guide and said pivotable lever.

* * * * *